United States Patent [19]

Matsuzaka et al.

[11] Patent Number: 4,770,978

[45] Date of Patent: Sep. 13, 1988

[54] METHOD FOR THE FORMATION OF IMAGE AND APPARATUS THEREFOR

[76] Inventors: Syoji Matsuzaka; Shin-ichi Daiba; Tsuyoshi Hattori, all of 1, Sakura-machi, Hino-shi, Tokyo, Japan

[21] Appl. No.: 893,094

[22] Filed: Aug. 1, 1986

[30] Foreign Application Priority Data

Aug. 9, 1985 [JP] Japan ..... 60-175373

[51] Int. Cl.[4] ..... G03C 7/00; G03C 7/16; G03C 5/04

[52] U.S. Cl. ..... 430/363; 430/383; 430/494; 430/945; 430/952

[58] Field of Search ..... 430/363, 945, 383, 494, 430/952

[56] References Cited

U.S. PATENT DOCUMENTS 3,148,058 9/1964 Land et al. ..... 430/494 X
3,811,885 5/1974 Marchant et al. ..... 430/945 X
4,160,669 7/1979 Habu et al. ..... 430/494 X
4,386,144 5/1983 Aono ..... 430/383 X
4,591,904 5/1986 Urabe et al. ..... 358/291 X

FOREIGN PATENT DOCUMENTS 2130397 5/1984 United Kingdom .

*Primary Examiner*—Mukund J. Shah
*Attorney, Agent, or Firm*—Jordan B. Bierman

[57] ABSTRACT

The present invention relates to an image forming method and apparatus in which a photographic material is subjected to an exposure by scanning with laser beam being of blue, green and red wavelengths as an exposure means, the photographic material used in the above scanning exposure process is a silver halide photographic material comprising blue, green and red sensitive silver halide emulsion layers, the silver halide of at least one of which emulsion layers is silver chloroiodobromide whose silver bromide content is from zero to 65 mol %.

10 Claims, 1 Drawing Sheet

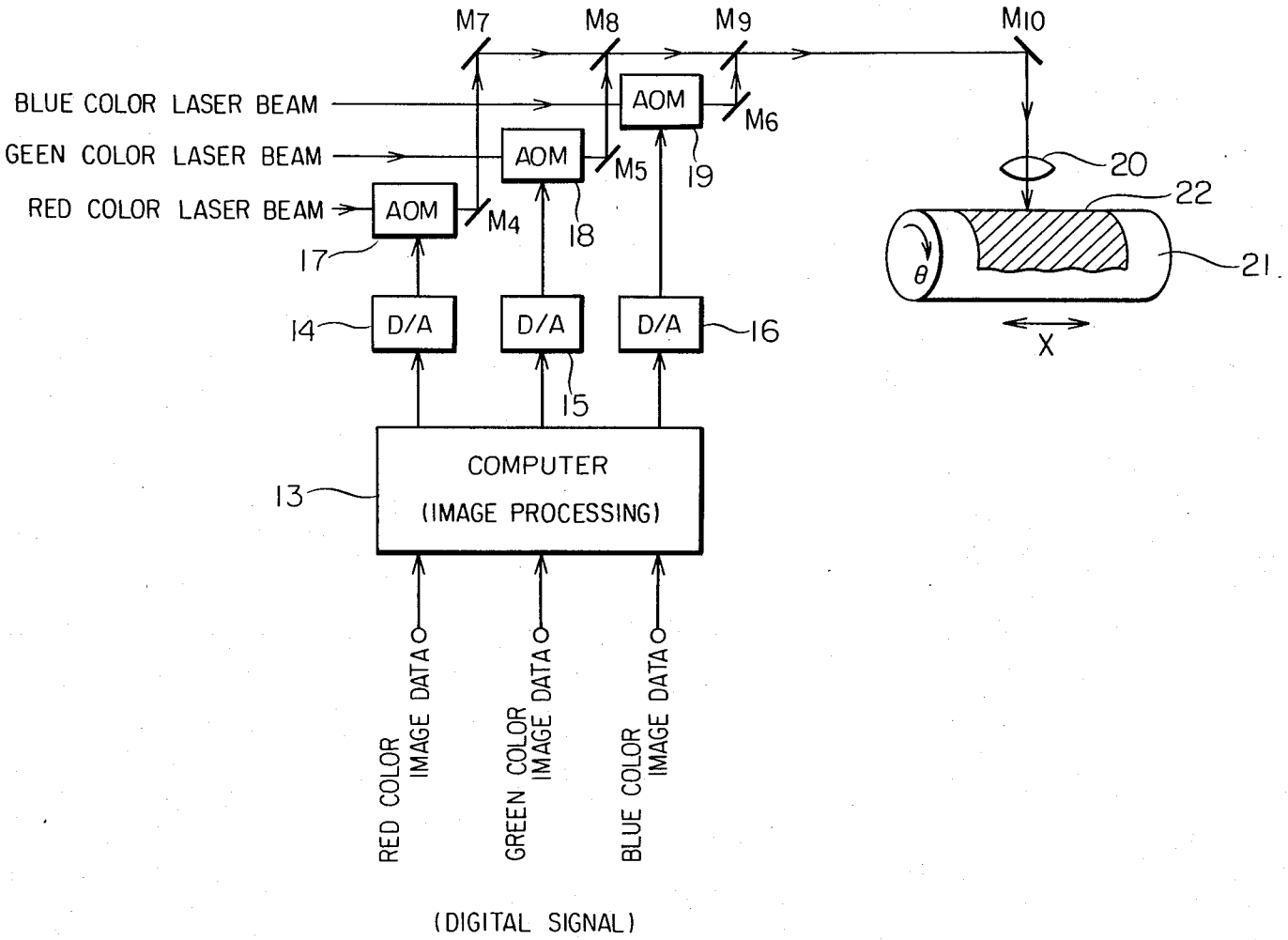
BLUE COLOR LASER BEAM
GEEN COLOR LASER BEAM
RED COLOR LASER BEAM
M7
M8
M9
M10
M4
M5
M6
AOM
AOM
AOM
17
18
19
D/A
D/A
D/A
14
15
16
COMPUTER
(IMAGE PROCESSING)
13
RED COLOR IMAGE DATA
GREEN COLOR IMAGE DATA
BLUE COLOR IMAGE DATA
(DIGITAL SIGNAL)
20
22
21
X
θ

METHOD FOR THE FORMATION OF IMAGE AND APPARATUS THEREFOR

BACKGROUND OF THE INVENTION

The present invention relates to a method for the formation of an image and an apparatus used therefor.

At present the widespread method for obtaining high-quality color photographic prints is such that photographing is made using a high-speed color negative film, and the photographed color negative film is color-developed to make a color negative, and through the color negative an exposure is made by means of a printer to a photographic color paper, and the exposed photographic color paper is then color-developed to thereby obtain a high-quality image color print (hereinafter called the negative-positive process).

On the other hand, because of the progress in the technologies for applying electronics, computers and laser beams and also in the precision machinery technology, it has become possible to record an original image on a photographic printing material including a photosensitive material not by way of focusing its color negative image through a lens system upon a photographic color paper but by way of converting the original image into electric signals or digital signals, then subjecting the signals to various conversion and correction treatments to thereby make output image signals, then according to the output color image signals, modulating by modulation means the quantities or intensity of laser beam lights in three colors: blue, green and red, and then deflecting and scanning the modulated three colors on the photographic material.

In the case where such the image forming method is used, the method is considered to have the following advantages as compared to the conventional negative-positive process:

(1) The conversions of gradations and colors can be easily made, and thus color prints can be easily obtained also from those original images other than color negatives (such as, for example, color reversals, color prints, printed matter, computer graphics, etc.).

(2) Various image processings can be made to produce high-quality images (for example, the smoothing treatment to reduce the graininess, the use of a Laplacian filter, etc., to stress the edge or to improve the sharpness, to compensate the out of focus or camera-shake in photographing, or to correct the underexposure or color of the light source used in exposure, and the like).

(3) Specific effects can be easily incorporated. For example, the preparation of composite images or composite pictures with character information, the rotation, movement, enlargement, reduction and making spatial distortion effects of images, the preparation of pseudo color images, and the mapping on three-dimentional objects, and the like.

(4) Color images can be transmitted remotely by utilizing a communication system.

The present invention relates to an image forming system suitable for use in obtaining high-quality image color prints, the system producing an output of a color image thus converted into electric signals or digital signals on a silver halide color photographic material (particularly photographic color paper) particularly by using laser beams.

Examples of the laser printer considered applicable to such the system include those described in, e.g., Japanese Patent Publication Open to Public Inspection (hereinafter referred to as Japanese Patent O.P.I. Publication) Nos. 4071/1980 and 11062/1984, Japanese Patent Examined Publication Nos. 14963/1981 and 40822/1981, European Patent No. 77410, technical report vol. 80, No. 244 by the Institute of Electronics and Communication Engineers of Japan, and SMPTE Journal (Society of Motion Picture and Television Engineers) 1984/6 (382), p. 34–36, and the like.

Any of such laser printers uses a very high-luminance laser beam light source, so that it has the following characteristics:

(1) The laser beam provides excellent resolution since it is capable of concentrating upon a very minute spot regardless of the exposure of film even if the amount of it is increased.

(2) Since the laser light has a high luminance, those low-speed, high-resolution, ultrafine-grained films or color paper can be used in addition to films for general photographing use.

(3) By the selection of a laser wavelength that causes no overlapping of colors to the spectral sensitivity characteristics of a color film, high-chroma color reproductions can be obtained.

(4) Since the gradation control can also be easily made, satisfactory gradation characteristics can be obtained.

(5) The display distortion produced by the deflector and optical system is very small.

The use of a laser printer enables to obtain a very high-quality color image even in the case where the image recording is made on a low-speed color paper. Examples of such the color paper include those as described in the Shashin Gijutsu Manual (Manual of Photographic Techniques), Part I: Fundamental Techniques (Shashin Kogyo Publishing Co., 1977), p. 53–61. Any of such photographic color papers comprises three different color sensitivity-having emulsion layers: blue-sensitive, green-sensitive and red-sensitive emulsion layers, comprising silver chlorobromide or silver chloroiodobromide whose silver bromide content is from 65 to 90 mole%.

Such the image forming system as described above is expected to be made a practical reality due to its many features as mentioned above as compared to the conventional method of making prints from color negatives by exposure, but there remain technical problems such as the cost and reliability of the apparatus, stabilization of resulting images, etc., yet to be solved.

However, we, the inventors, have been faced with unexpectedly difficult problems that, when the above image forming system is used, contrary to our expectation, the system is significantly inferior in the color reproducibility to the conventional negative-positive process (particularly the purity of yellow color is deteriorated). This fact runs counter to the theoretical expectation that the use of the laser beam improves the color purity as compared to the conventional negative-positive process because it is a monochromatic light.

SUMMARY OF THE INVENTION

It is therefore an object of the present invention to provide and make a practical reality a system which is as follows: in an image-forming apparatus as in the above system to form a color image on a photographic color paper by three-color laser beam scanning exposure, the system is capable of overcoming the disadvantage that the color purity is inferior to the conventional negative-positive process. That is, it is to provide a method or system which, without being inferior in the color reproducibility to the conventional negative-positive process, is capable of making various compensations or conversions of color images on electric signal leves or digital levels that have been impossible in the conventional negative-positive process (for example, gradation conversion, color conversion, compensations, stresses and improvements of graininess and sharpness, various additional procedures such as rotation, movement, enlargement, reduction, image composition, etc.).

Namely, the present invention relates to an image forming method in which, where a photographic material is subjected to an exposure by scanning exposure means using blue, green and red wavelengths, the photographic material used in the above scanning exposure means is a silver halide photographic material comprising blue-sensitive, green-sensitive and red-sensitive silver halide emulsion layers, the silver halide of at least one of which emulsion layers is silver chloroiodobromide whose silver bromide content is from zero to 65 mole%.

In the method of this invention, the foregoing scanning exposure means is desirable to be a laser. Other preferred embodiment is such that the foregoing scanning exposure should be a picture element-division type exposure in which the scanning exposure is devided into picture element, the exposure time per picture element should be not more than $10^{-2}$ second, the aperture of each picture element in the foregoing scanning exposure should be not more than 1000 $\mu$m, and the scanning exposure means which use the foregoing blue, green and red wavelengths should each be for not less than four-step gradations. And also the silver bromide content of the silver halide of the foregoing red-sensitive silver halide emulsion layer should account for zero to 65 mole%, the average grain size of the silver halide grains of the foregoing blue-sensitive silver halide emulsion layer should be from 0.20 to 1.0 $\mu$m, and the silver halide of the green-sensitive emulsion layer of the foregoing silver halide emulsion layers should be a monodisperse emulsion.

The present invention provides also an image forming apparatus for practicing the method of the invention, the said apparatus having a scanning exposure means which uses blue, green and red wavelength lights and having a silver halide photographic material to be processed after the scanning exposure by the scanning exposure means, the silver halide photographic material comprising blue-sensitive, green-sensitive and red-sensitive silver halide emulsion layers, the silver bromide content of the silver halide of at least the green-sensitive silver halide emulsion layer of which emulsion layers is from zero to 65 mole%.

BRIEF DESCRIPTION OF THE DRAWING

The accompanying drawing is a schematic diagram of a scanning exposure-type image forming apparatus according to an example of this invention.

DETAILED DESCRIPTION OF THE INVENTION

The preferred embodiment of this invention is such that, in an image forming apparatus for use in obtaining a color image by processing a photographic color paper subjected to a scanning exposure with the use of a scanning exposure means using three-color laser beams in blue, green and red colors, the said scanning exposure means and photographic color paper have the following characteristics (A) and (B), respectively:

(A) Scanning exposure means:

(a) The scanning exposure means has a compensation means for compensating the image to be recorded on a photographic color paper so as to be finished to be of the optimum color and gradation.

(b) The scanning exposure means has a light modulation means for modulating the amounts or intensity of the respective laser beam lights according to the color image output signals from the foregoing compensation means and a deflectable scanning means for deflecting the modulated three color lights to thereby record an image on the photographic color paper.

(B) Photographic color paper:

The photographic color paper is a silver halide color photographic material comprising a reflective support having thereon a blue-sensitive silver halide emulsion layer, a green-sensitive silver halide emulsion layer and a red-sensitive silver halide emulsion layer, the said green-sensitive silver halide emulsion layer containing silver bromide accounting for zero to 65 mole% of the silver halide thereof.

According to the present invention, the combined use of the above scanning exposure means and the above silver halide photographic material comprising the low silver bromide-content (zero-65 mole%) green-sensitive emulsion layer enables to solve the foregoing problem caused in the scanning exposure using the laser beam; i.e., the problem peculiar to such exposure means that color turbidity occurs in the yellow color image.

Furthermore, the discretionary manipulation of the gradation, color, sharpness, graininess, etc., which are impossible in the conventional negative-positive process, can be carried out, thus enabling the obtaining of the highest-ever quality color image.

In the conventional negative-positive process, the separation of blue, green and red color lights at the time of exposure is by no means satisfactory in the color turbidity because the spectral absorptions of the yellow (Y), magenta (M) and cyan (C) dyes formed on a color negative are not sharp and overlapped. In contrast, where three-color laser beam lights are used, the exposure of a photographic color paper uses laser lights which are much more highly monochromatic than the formed dyes of a color negative, so that it is theoretically expected that the color turbidity is less than that in the negative-positive process. It was totally unexpected difficulty, however, that the actual yellow color formed (exposed to a blue laser light) was more largely turbid than in the negative-positive process to the contrary. What has caused this is still not certain, but we have assumed that this phenomenon will probably be due to the following facts:

That is, the exposure time used in the ordinary negative-positive process is hundreds of milliseconds ($10^{-1}$ sec), while, in such the scanning exposure of this invention, the exposure time at a spatial point on a photographic material is 2 to 5 figures as extraordinarily short as milliseconds ($10^{-3}$ sec) to microseconds ($10^{-6}$ sec). Any of those conventional color photographic materials (photographic color paper) is so designed as to be optimum for the negative-positive-type exposure, but in the case where the exposure time largely differs as mentioned above, it is known that there occurs a problem called the reciprocity law failure. That is, even if an exposure (exposure time×illuminance) given to the photographic material is the same, the same image density can not be obtained. An ordinary silver halide photographic material has its sensitivity lowered under an extremely high-illuminance exposure condition or an extremely low-illuminace exposure condition (high illuminance reciprocity law failure and low illuminance reciprocity law failure).

Such the condition as in the laser scanning exposure is certainly in the region where the high illuminance reciprocity law failure occurs. We have assumed that the foregoing problem is likely to be due to the characteristics of the high illuminance reciprocity law failure. In other words, the difference in the reciprocity law failure between the three light-sensitive layers different in the color sensitivity of the photographic color paper is considered to be the cause. The green-sensitive layer (orthochromatic layer) and red-sensitive layer (panchromatic layer) are spectrally sensitized by appropriate sensitizing dyes to the respective spectral regions, and at the same time they are also sensitive to a blue light which is in the intrinsic sensitive region of silver halide (the intrinsic sensitivity of silver halide). An ordinary photographic color paper is so designed that the sensitivity to blue of the blue-sensitive layer (regular layer) is made adequately high as compared to the intrinsic sensitivities of the orthochromatic and panchromatic layers, whereby no color turbidity occurs. However, if the high illuminance reciprocity law failure of the blue-sensitive layer is larger (sensitivity deterioration is larger) than those of the other color-sensitive layers, in the scanning exposure (i.e., in the high illuminance short exposure), the difference in the intrinsic sensitivity between the blue-sensitive layer and the other layers becomes reduced, whereby the previously mentioned color turbidity is considered to occur.

As a result of our continued investigation based on this assumption, it has now been found that the above problem can be effectively solved by using at least an emulsion containing a small amount (zero–65 mole%) of silver bromide as the silver halide emulsion of a green-sensitive layer. This supports the above-mentioned assumption because if the silver bromide content is small, the absorption of a blue light becomes small, and when it is used in the green-sensitive layer (further in the red-sensitive layer), the intrinsic sensitivity becomes reduced.

Thus, the blue light absorption by the green-sensitive layer (further the red-sensitive layer as the case may be) is so small that the sensitivity of the layer differentiates sufficiently from that of the blue-sensitive layer, whereby the color turbidity is largely reduced. For this reason, the silver bromide content of the green-sensitive layer or red-sensitive layer is desirable to be not more than 65 mole%. If it exceeds 65 mole%, the above intrinsic sensitivity increases to excess, thus making it difficult to prevent the color turbidity, provided, however, that although the silver bromide content is allowed to be zero, if the content is less than 5 mole%, the processing stability (the stability of the composition, pH, temperature, bromide ion concentration, etc., of the developer liquid used in processing) becomes worsened, so that the content is desirable to be not less than 5 mole%.

In this invention, silver iodide may be incorporated to an extent not to impair the effect of this invention. Silver iodide is used normally not more than 2 mole%.

As for the red, green and blue laser beams used as the light sources in this invention, monochromatic gas lasers, monochromatic semiconductor lasers, or the combination of a white or complex color laser with filters, or the combination of these lasers are considered to be usable. Monochromatic gas lasers are most commonly used because their output is stable and high. The combination of a white or complex color laser with filters is of a single light source and can be of a compact type. Accordingly, monochromatic gas lasers are most suitable as the light source. As the red laser, for example, He-Ne laser (wavelength 632.8 nm) is used, as the green laser, e.g., $Ar^+$ laser (wavelength 514.5 nm) is used, and as the blue laser, e.g., He-Cd laser (wavelength 441.6 nm) is most suitable.

These laser lights, by colors, may be subjected to light modulation corresponding to the image data. In the case of a semiconductor laser, direct current modulation can be made. In other lasers, an electrooptic light modulator or acoustooptic modulator (AOM) is used. The laser lights, by colors, are each monitored on the light intensity thereof, and the light intensity is stabilized by the procedure of feed back or feed forward or the combined use of these. As for the light scanning, the following procedures are usable in combination of those:

| Main scanning | Subscanning |
|---|---|
| Drum rotation | Galvanometer |
| " | Drum movement by ball screws (Japanese Patent Examined Publication No. 40822/1981) |
| " | Lens movement by ball screws which is a moving means to the subscanning direction. (Japanese Patent Examined Publication No. 11062/1984) |
| Galvanometer | Galvanometer (Japanese Patent O.P.I. Publication No. 4071/1980) |
| " | Transport of roll photographic material |
| Polygonal mirror | Galvanometer |
| " | Transport of roll photographic material (Japanese Patent Examined Publication No. 14963/1981) |

The input method is classified into the following two types:

(1) Direct input:

Image informations may be directly inputted as digitalized signals correspond to blue, green and red color image data by an input system, such as the system capable of reading image informations from transmitted light through color negative film and color reversal film or from reflected light from color paper, or capable of converting video signal from video system.

(2) Input from media:

Image informations may be also inputted from media capable of storing image data therein, such as magnetic tape, magnetic disk, laser disk, photomagnetic disk and so on.

It is possible to store input information in the frame memory and to conduct various image processing operations.

Any discretional sharpness can be obtained (by Laplacian operation, etc.).

The smoothing of the graininess of silver halide film can be made.

Gradation conversion can be made.

Color conversion can be made to thereby obtain any desired color.

Afine conversion can be made (enlargement, reduction, rotation, parallel movement, trimming, mapping, composition, etc.).

As for the processor to conduct image processings, a general-purpose conputer may be utilized, or an exclusive-use computer-built-in processor may be used.

The image processing can be speeded up by use of the parallel processing or pipeline processing method.

Both supplier and receiver may be provided for the paper for output use:

As for the feeding methods of feeding color paper onto a drum, a sheet of color paper may be fitted in advance onto the drum in a portable darkbox and a stack of color paper stored in a cassette tray may be fed onto the drum in a darkbox.

Further, roll type-color paper stored in a cassette tray may be fed onto the drum in a darkbox, in this case, both supplier and receiver may be provided for the paper for output use.

The writing rate: from several m sec to several $\mu$ sec.

The size of picture element (aperture) is preferably not more than 1000 $\mu$m, and more preferably not more than 150 $\mu$m.

Output image sizes: there are four image frame sizes (254×304 mm to 20×20 mm).

Number of gradations: not less than four gradations each for B, G and R (for those images including gradational pictures or photos, the number of gradations is preferably not less than 16 gradations, more preferably not less than 36 gradations, and most preferably not less than 64 gradations).

The accompanying drawing shows an example of the image forming apparatus of this invention, wherein 14 through 16 each is a D/A converter for converting into analogue signals (density signals) for each color those subjected to given operation processings by compurter 13, and 17 through 19 are optical modulators for modulating the red laser light, green laser light and blue laser light, respectively, by output signals from the foregoing D/A converters 14 through 16. The red laser light may be He-Ne (632.8 nm), the green laser light may be $Ar^+$ (514.5 nm), and the blue laser light may be He-Cd (441.6 nm). $M_4$ through $M_6$ are mirrors to receive output lights from optical modulators 17 through 19, respectively, and $M_7$ through $M_9$ are mirrors to receive reflected lights from the foregoing mirrors $M_4$ through $M_6$. $M_{10}$ is a mirror to receive the reflected lights from the mirrors $M_7$ through $M_9$. 20 is a condenser lens to converge the reflected light from the mirror $M_{10}$. 21 is a drum, and 22 is a sheet of photographic color paper (recording sheet) wound around the drum 21. Upon the recording sheet 22 is made incident the transmitted light through the lens 20. And on the drum 20, main scanning is conducted in the direction of its rotation (in the direction of $\theta$) and subscanning is conducted in the direction of axis (in the direction of X). The drum 21 is driven in the main scanning direction by the revolution of a motor, and the subscanning is conducted by moving the optical system in parallel by a ball screw.

Subsequently, the silver halide color photographic material used in this invention is desirable to be such that, in a silver halide color photographic material comprising a reflective support having thereon a blue-sensitive silver halide emulsion layer, a green-sensitive silver halide emulsion layer and a red-sensitive silver halide emulsion layer, the green-sensitive silver halide emulsion layer's silver halide contains at least zero to 65 mole% silver bromide, and preferably the red-sensitive silver halide emulsion layer's silver halide also contains 5 to 65 mole% silver bromide.

The silver halide contained in the blue-sensitive silver halide emulsion layer of this invention is of an average grain size of from 0.20 to 1.0 $\mu$m, preferably from 0.20 to 0.55 $\mu$m, and more preferably from 0.30 to 0.50 $\mu$m. If the average grain size is larger, exceeding the range, a lengthy developing time is required, thus tending to impair the developing rapidness, while if the average grain size is less than 0.20 $\mu$m, the speed of the blue-sensitive silver halide emulsion layer is lowered, thus tending to cause the magenta color to be turbid.

The measurement of the average grain size of the silver halide contained in the blue-sensitive silver halide emulsion layer of this invention can be carried out by any of those various methods commonly used by those skilled in the art. Examples representative of the measuring method include those described in R. P. Loveland, 'Particle-Size Measurement', A.S.T.M. Symposium on Light Microscopy', 1955, p.94–122, and Chapter 2 of the 'Theory of the Photographic Process' by Mees and James, 3rd ed., MACMILLAN (1966).

The silver halide used in this invention is allowed to be of a polydisperse emulsion whose average grain sizes are widely distributed, but is more desirable to be of a substantially monodisperse emulsion.

The aforementioned substantially monodisperse emulsion is of those silver halide grains, most of which, when viewed through an electron microscope, look similar in the configuration and uniform in the grain size, and whose grain sizes' coefficient of variation is not more than 20%, and more preferably not more than 15%, wherein the coefficient of variation is expressed by the following equation:

$$\text{Coefficient of variation (\%)} = \frac{\text{Standard deviation of grain sizes}}{\text{Average grain size}} \times 100$$

The term 'grain size' used herein, in the case of a cubic silver halide grain, is defined as the length of one of the sides thereof, or in the case of a noncubic silver halide grain, is defined as the length of one of the sides of an assumed cube corresponding in the volume to the grain.

The grain size distribution can be determined by those methods as described in the 'Empirical Relations between Sensitometric and Size-Frequency Characteristics in Photographic Emulsion Series' by Trivelli and Smith in The Photographic Journal, vol. LXXIX (1949), p. 330–338.

The silver halide contained in the green-sensitive silver halide emulsion layer and red-sensitive silver halide emulsion layer of this invention may be silver chlorobromide, silver chloroiodobromide or a mixture of these silver halides, whose silver bromide content is desirable to be from zero to 65 mole%.

Either one of or both of the green-sensitive silver halide emulsion layer and red-sensitive silver halide emulsion layer of this invention may be each comprised of two more more layers. And in this invention, the silver bromide content means the percentage of the total amount of the silver bromide accounting for of the whole silver halides contained in all the green-sensitive silver halide emulsion layers and all the red-sensitive silver halide emulsion layers.

If the silver halide contained in the green-sensitive silver halide emulsion layer and red-sensitive silver halide emulsion layer is silver chloroiodobromide, the silver bromide content thereof is desirable to be not more than 2 mole%.

The silver bromide content of the green-sensitive silver halide emulsion layer and red-sensitive silver halide emulsion layer is preferably from 20 to 60 mole%, and more preferably from 30 to 55 mole%.

The silver halide contained in the green-sensitive silver halide emulsion layer and red-sensitive silver halide emulsion layer is also desirable to be as substantially monodisperse as the silver halide contained in the foregoing blue-sensitive silver halide emulsion layer.

The composition of the silver halide contained in the blue-sensitive silver halide emulsion is not particularly restricted but may be any of silver bromide, silver chlorobromide or silver chloroiodobromide, or a mixture of these silver halides, but preferably silver chlorobromide, whose silver bromide content is from 30 to 95 mole%. In addition, the blue-sensitive silver halide emulsion layer may also be comprised of two or more layers.

The average grain size of the silver halide contained in the green-sensitive halide emulsion layer and red-sensitive silver halide emulsion layer is not particularly defined, but is preferably from 0.1 to 2 μm, and particularly preferably from 0.25 to 0.8 μm.

The silver halide color photographic material of this invention has three light-sensitive silver halide emulsion layers substantially different in the color sensitivity; i.e., a blue-sensitive silver halide emulsion layer, a green-sensitive silver halide emulsion layer and a red-sensitive silver halide emulsion layer. The coating positions of the three light-sensitive silver halide emulsion layers different in the color sensitivity are not particularly restricted, but the constructions represented by the following (1) through (4) are preferred.

| | (1) | (2) | (3) | (4) |
|---|---|---|---|---|
| ↓ | Red-sensitive layer (R) | G | B | B |
| ↓ | Green-sensitive layer (G) | R | G | R |
| ↓ | Blue-sensitive layer (B) | B | R | G |
| Bottom | Reflective support (base) | Base | Base | Base |

These layers each may be a single layer or comprised of two or more layers, and may also have one or more interlayers between the respective layers, between the reflective support and the layer immediately adjacent thereto, or outside the layer located furthest from the support, and such the interlayer may, if necessary, contain additives such as an ultraviolet absorbing agent, silver halide fine grains, antistain agent, and the like.

The amount of silver (coating amount of silver) of the silver halide emulsion layers in the silver halide color photographic material of this invention is not particularly definite, but is preferably from 0.3 to 1 g/m$^2$ in the whole of the light-sensitive silver halide emulsion layers.

Namely, in order to obtain an excellent image quality, the coating amount of silver is desirable to be not more than 1 g/m$^2$, while, in order to obtain a high maximum density and a high sensitivity, the coating amount of silver is desirable to be not less than 0.3 g/m$^2$.

The silver halide composition advantageously usable in this invention is silver chlorobromide or silver chloroiodobromide or a mixture of these silver halides. That is, where the silver halide emulsion of this invention is used for a color photographic paper, particularly rapid processability is required, so that the silver halide is desirable to contain a chlorine atom as the halide composition and particularly desirable to be the silver chlorobromide or silver chloriodobromide containing at least 1% silver chloride.

The crystal of these silver halide grains is allowed to be in the normal or twin form or other forms, and those silver halide grains whose crystals are of an arbitrary [1.0.0] face-[1.1.1] face proportion may be used. Further, the crystal of these silver halide grains may be of either a homogeneous structure from the inside through the outside or a heterogeneous structure stratified with the inside and outside layers different in nature (core/-shell type). And these silver halides may be either of the type of forming a latent image mainly on the grain surface or of the type of forming a latent image inside the grain. Further, plate-crystal silver halide grains (reference can be made to Japanese Patent O.P.I. Publication No. 113934/1983, Japanese Patent Application No. 170070/1984) may also be used. The monodisperse silver halide grains suitable usable in this invention may be those prepared by any of the acid method, neutral method, ammoniacal method, and the like, or may also be those prepared in the manner that, for example, seed grains are first prepared by the acid method, and then grown rapidly by the ammoniacal method up to an extent that the specified grain size is obtained. In the process of growing the silver halide grains, it is desirable to pour sequentially and simultaneously silver and halide ions in quantities meeting the growth rate of silver halide grains into the reactor with the pH, pAg, etc., thereinside being controlled, as described in, e.g., Japanese Patent O.P.I. Publication No. 48521/1979.

The preparation of such silver halide grains of this invention are carried out as has been described above. The composition containing such silver halide grains is called the silver halide emulsion in this specification.

The silver halide emulsion may be chemically sensitized by active gelatin; sulfur sensitizers such as allylthiocarbamide, thiourea, cystine, etc.; selenium sensitizers; reduction sensitizers such as stannous salts, thiourea dioxide, polyamines, etc.; noble-metallic sensitizers including gold sensitizers such as potassium aurithiocyanate, potassium chloroaurate, 2-aurothio-3-methylbenzothiazolium chloride, etc., water-soluble salts of e.g., ruthenium, palladium, platinum, rhodium, iridium, etc., such as ammonium chloropalladate, potassium chloroplatinate and sodium chloropalladate (some of these sensitizers function as either sensitizers or antifoggants depending on the amount to be used); and the like. These sensitizers may be used alone or in discretional combination (e.g., in combination of a gold sensitizer and sulfur sensitizer, a gold sensitizer and selenium sensitizer, and the like).

The silver halide emulsion of this invention may be chemically ripened by the addition thereto of a sulfur-containing compound, and to this emulsion at least one hydroxytetrazaindene and at least one mercapto group-having nitrogen-containing heterocyclic compound may be added before, during or after the chemical ripening.

The silver halide used in this invention, in order to be sensitized to a desired spectral wavelength region, may be optically sensitized by adding thereto an appropriate sensitizing dye in a quantity of from $5\times10^{-8}$ to $3\times10^{-3}$ moles. As the sensitizing dye various ones may be used alone or in combination of two or more. Examples of such sensitizing dyes suitably usable in this invention include the following ones:

Examples of the sensitizing dyes usable in the blue-sensitive silver halide emulsion include those as described in, e.g., West German Pat. No. 929,080, U.S. Pat. Nos. 2,231,658, 2,493,748, 2,503,776, 2,519,001, 2,912,329, 3,656,959, 3,672,897, 3,694,217, 4,025,349, 4,046,572, British Pat. No. 1,242,588, Japanese Patent Example Publication Nos. 14030/1969, 24844/1977, and the like. Typical examples of the sensitizing dyes usable for the green-sensitive silver halide emulsion include those cyanine dyes, merocyanine dyes or complex cyanine dyes as described in, e.g., U.S. Pat. Nos. 1,939,201, 2,072,908, 2,739,149, 2,945,763, British Pat. No. 505,979, and the like. And typical examples of the sensitizing dyes usable for the red-sensitive silver halide emulsion layer include those cyanine dyes, merocyanine dyes or complex cyanine dyes as described in, e.g., U.S. Pat. Nos. 2,269,234, 2,270,378, 2,442,710, 2,454,629, 2,776,280, and the like. In addition, those cyanine dyes, merocyanine dyes or complex cyanine dyes as described in U.S. Pat. Nos. 2,213,995, 2,493,748, 2,519,001, West German Pat. No. 929,080, etc., may also be used advantageously for the green-sensitive silver halide emulsion or red-sensitive silver halide emulsion.

These sensitizing dyes may be used alone or in combination.

The photographic material of this invention may be optically sensitized to desired spectral wavelength regions by the spectral sensitization method with the single or combined use of cyanine dyes or merocyanine dyes. Particularly preferred examples of the spectral sensitization method include those methods using the combination of benzimidazolocarbocyanines with benzoxazolorcarbocyanines as described in Japanese Patent Examined Publication Nos. 4936/1968, 22884/1968, 18433/1970, 37443/1972, 28293/1973, 6209/1974, 12375/1978, Japanese Patent O.P.I. Publication Nos. 23931/1977, 51932/1977, 80118/1979, 153926/1983, 116646/1984, 116647/1984, and the like.

And those relating to the combination of benzimidazole nucleus-having carbocyanines with other cyanines or with merocyanines are described in, e.g., Japanese Patent Examined Publication Nos. 25831/1970, 11114/1972, 25379/1972, 38406/1973, 38407/1973, 34535/1979, 1569/1980, Japanese Patent O.P.I. Publication Nos. 33220/1975, 38526/1975, 107127/1976, 115820/1976, 135528/1976, 104916/1977, 104917/1977, and the like.

Further, those relating to the combination of benzoxazolocarbocyanines (oxacarbocyanines) with other carbocyanines are found in, e.g., Japanese Patent Examined Publication Nos. 32753/1969, 11627/1971, Japanese Patent O.P.I. Publication No. 1483/1982, and those relating to merocyanines are disclosed in Japanese Patent Examined Publication Nos. 38408/1973, 41204/1973, 40662/1975, Japanese Patent O.P.I. Publication Nos. 25728/1981, 10753/1983, 91445/1983, 116645/1984, 33828/1975, and the like.

Those relating to the combination of thiacarbocyanines with other carbocyanines are described in, e.g., Japanese Patent Examined Publication Nos. 4932/1968, 4933/1968, 26470/1970, 18107/1971, 8741/1972, Japanese Patent O.P.I. Publication No. 114533/1984, and the like, and further those methods using zeromethine or dimethine merocyanines, monomethine or trimethine cyanines and styryl dyes may be advantageously used which are described in Japanese Patent Examined Publication No. 6207/1974.

In order to incorporate such sensitizing dyes into the silver halide emulsion of this invention, the dye is used in the form of a dye solution prepared in advance by being dissolved into a hydrophilic organic solvent such as methyl alcohol, ethyl alcohol, acetone, dimethyl formamide, or fluorinated alcohol described in Japanese Patent Examined Publication No. 40659/1975.

The time when such sensitizing dyes should be added to the silver halide emulsion is a discretional point of time such as in the initial stage of, during or upon completion of the ripening of the emulsion, or as the case may be, they may be added in the process immediately before the coating of the emulsion.

The silver halide color photographic material of this invention may contain a water-soluble dye as the filter dye for the hydrophilic colloid layer thereof or for the anti-irradiation or various other purposes. Examples of such the dye include oxonol dyes, hemioxonol dyes, merocyanine dyes and azo dyes. Of these dyes, the oxonol, hemioxonol and merocyanine dyes are useful. Concrete examples of these useful dyes are described in British Pat. Nos. 584,609, 1,277,429, Japanese Patent O.P.I. Publication Nos. 85130/1973, 99620/1974, 114420/1974, 129537/1974, 108115/1977, 25845/1984, U.S. Pat. Nos. 2,274,782, 2,533,472, 2,956,879, 3,125,448, 3,148,187, 3,177,078, 3,247,127, 3,540,887, 3,574,704, 3,653,905, 3,718,472, 4,071,312 and 4,070,352.

The silver halide emulsion of this invention may contain couplers, i.e., those compounds capable of reacting with the oxidized product of a color developing agent to thereby form dyes.

In the present invention, as the above couplers those conventionally known yellow couplers, magenta couplers and cyan couplers may be used. These couplers may be either two-equivalent-type couplers or four-equivalent-type couplers. And diffusible dye releasing-type couplers may also be used in combination with these couplers.

Useful examples of the above yellow coupler include those conventionally used open-chain ketomethylene compounds, and further, those called two-equivalent-type couplers such as active site-o-aryl-substituted couplers, active site-o-acyl-substituted couplers, active site hydantoin compound-substituted couplers, active site urazole compound-substituted couplers, active site succinic acid imide compound-substituted couplers, active site fluorine-substituted couplers, active site chlorine or bromine-substituted couplers, active site-o-sulfonyl-substituted couplers, and the like. Concrete examples of the yellow couplers usable in this invention include those as described in U.S. Pat. Nos. 2,875,057, 3,265,506, 3,408,194, 3,551,155, 3,582,322, 3,725,072, 3,891,445, West German Pat. No. 1,547,868, West German OLS Pat. Nos. 2,219,917, 2,281,361, 2,414,006, British Pat. No. 1,425,020, Japanese Patent Examined Publication No. 10783/1976, Japanese Patent O.P.I. Publication Nos. 26133/1972, 73147/1973, 102636/1976, 6341/1975, 123342/1975, 130442/1975, 21827/1976, 87650/1975, 82424/1977, 115219/1977, 95346/1983, and the like.

Examples of the magenta coupler used in this invention include pyrazolone-type, pyrazolotriazole-type, pyrazolinobenzimidazole-type and indazolone-type compounds.

These magenta couplers may be either four-equivalent-type or two-equivalent-type couplers just as the yellow couplers may be. Concrete examples of the magenta couplers include those as described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German OLS Pat. Nos. 2,408,665, 2,417,945, 2,418,959, 2,424,467, Japanese Patent Examine Publication No. 6031/1965, Japanese Patent O.P.I. Publication Nos. 20826/1976, 58922/1977, 129538/1974, 74027/1974, 159336/1975, 42121/1977, 74028/1974, 60233/1975, 26541/1976, 55122/1978, Japanese Patent Application No. 110943/1980, and the like.

Further, those useful cyan couplers applicable to this invention include, e.g., phenol-type and naphthol-type couplers, and these cyan couplers may be either four-equivalent or two-equivalent couplers just as the yellow couplers may be. Concrete examples of the cyan couplers include those as described in U.S. Pat. Nos. 2,369,929, 2,434,272, 2,474,293, 2,521,908, 2,895,826, 3,034,892, 3,311,476, 3,458,315, 3,478,563, 3,583,971, 3,591,383, 3,767,411, 4,004,929, West German OLS Pat. Nos. 2,414,830, 2,454,329, Japanese Patent O.P.I. Publication Nos. 59838/1973, 26034/1976, 5055/1973, 146827/1976, 69624/1977, 90932/1977, 95346/1983, and the like.

In the silver halide emulsion layer and other photographic component layers of this invention, such couplers as DIR compounds, nondiffusible couplers which react with the oxidized product of a color developing agent to produce moderately spreading diffusible dyes, polymer couplers and the like may be used in combination. For the nondiffusible DIR compounds and the nondiffusible couplers which react with the oxidized product of a color developing agent to produce moderately spreading diffusible dyes, reference can be made to Japanese Patent Application No. 193611/1984 by us applicant, and for the polymer couplers reference can be made to Japanese Patent Application No. 172151/1984 by us applicant, and further, for the DIR compounds reference can be made to Japanese Patent Application No. 158782/1984 also by us applicant.

In order to incorporate such couplers into the silver halide emulsion layer of this invention, the coupler, if alkali-soluble, may be added in the form of an alkaline solution, while if oil-soluble, is desirable to be dissolved into a high-boiling solvent, if necessary, in combination with a low-boiling solvent and dispersed in the fine particulate form into the silver halide emulsion in accordance with any of those methods as described in, e.g., U.S. Pat. Nos. 2,322,027, 2,801,170, 2,801,171, 2,272,191 and 2,304,940. In this instance, if necessary, additives such as a hydroquinone derivative, ultraviolet absorbing agent, antibrown-discoloration agent, and the like are allowed to be used in combination. And two or more such couplers may be mixed to be used. Further, referring in detail to the preferred coupler adding method in this invention, one or more of the above couplers, if necessary, together with other couplers, hydroquinone derivative, antibrown-discoloration agent, ultraviolet absorbing agent, etc., are dissolved into a high-boiling solvent, examples of which include organic acid amides, carbamates, esters, ketones, unrea derivatives, ethers, hydrocarbons, such as particularly di-n-butyl phthalate, tricresyl phosphate, triphenyl phosphate, di-isooctyl azelate, di-n-butyl sebacate, tri-n-hexyl phosphate, N,N-diethyl-caprylamidobutyl, N,N-diethyl-laurylamide, n-pentadecyl-phenyl ether, di-octyl phthalate, n-nonyl-phenol, 3-pentadecyl-phenylethyl ether, 2,5-di-sec-amyl-phenylbutyl ether, monophenyl-di-o-chlorophenyl phosphate, fluorinated paraffin, or the like, and/or a low-boiling solvent such as methyl acetate, ethyl acetate, propyl acetate, butyl acetate, butyl propionate, cyclohexanol, diethylene glycol monoacetate, nitromethane, carbon tetrachloride, chloroform, cyclohexanetetrahydrofuran, methyl alcohol, acetonitrile, dimethylformamide, dioxane, methyl-ethyl ketone, or the like, and the solution is then mixed with an aqueous solution containing an anionic surfactant such as an alkylbenzene-sulfonic acid, alkylnaphthalenesulfonic acid, etc., and/or a nonionic surfactant such as a sorbitanesesquioleic acid ester, sorbitanmonolauric acid ester, etc., and/or a hydrophilic binder such as gelatin, and the resulting mixture is then emulsifiedly dispersed by means of a high-speed rotary mixer, colloid mill, ultrasonic disperser, or the like, and the thus dispersed liquid is added to the silver halide emulsion.

Alternatively, the above coupler may be dispersed by using the latex dispersion method. The latex dispersion method and the effect thereof are described in Japanese Patent O.P.I. Publication Nos. 74538/1974, 59943/1976 and 32552/1979, and Research Disclosure October 1976, No. 14850, p. 77–79.

Suitable examples of the latex include those homopolymers, copolymers and terpolymers of such monomers as, e.g., styrene, acrylates, n-butyl acrylate, n-butyl methacrylate, 2-acetacetoxyethyl methacrylate, 2-(methacryloyloxy)ethyltrimethylammonium methosulfate, sodium 3-(methacryloyloxy)propane-1-sulfonate, N-isopropylacrylamide, N-[2-(2-methyl-4-oxopentyl)]acrylamide, 2-acrylamido-2-methylpropanesulfonic acid, and the like.

The silver halide color photographic material of this invention may contain various other photographic additives such as those antifoggants, stabilizers, ultraviolet absorbing agents, antistain agents, brightening agents, color image antidiscoloration agents, antistatic agents, hardeners, surfactants, plasticizers, wetting agents, and the like, as described in Research Disclosure 17643.

In the silver halide color photographic material of this invention, the hydrophilic colloid for use in the preparation of the emulsion includes proteins such as gelatin, derivative gelatin, graft polymers of gelatin with other high-molecular compounds, albumin, casein, etc.; cellulose derivatives such as hydroxyethyl cellulose derivatives, carboxymethyl cellulose derivatives, etc.; starch derivatives; synthetic hydrophilic high-molecular homo- or copolymer materials such as polyvinyl alcohols, polyvinylimidazoles, polyacrylamides, etc.; and the like.

The support of the silver halide color photographic material of this invention may be any of reflective support materials which include, e.g., baryta paper, polyethylene-laminated paper, polypropylene synthetic paper, reflective layer-laminated or reflective material-combined transparent support such as glass plates, cellulose acetate film, cellulose nitrate film, or polyester film such as of polyethylene terephthalate, polyamide film, polycarbonate film, polystyrene film, and the like. These support materials may be arbitrarily selected according to the purpose for which the photographic material is used. The emulsion layers and other component layers used in this invention may be coated by any of various coating methods including the dipping coating, air doctor coating, curtain coating, hopper coating, and the like methods. In addition, those methods of coating two or more layers simulaneously as described in U.S. Pat. Nos. 2,761,791 and 2,941,898 may also be used.

The photographic material of this invention may contain arbitrarily appropriate thickness-having interlayers which may be provided in combination with additional various component layers such as filter layers, anticurl layer, protective layer, antihalation layer, and the like. For these component layers the foregoing hydrophilic colloid as the binder usable in the emulsion layers may be used likewise. And into these layers may be incorporated those various photographic additives usable in the foregoing emulsion layers.

No particular restrictions are put on the method of processing the photographic material having the silver halide emulsion of this invention, and any of all processing methods can be used. Typical processing methods include: color developing, bleach-fix, if necessary washing and/or stabilizing; color developing, bleaching, fixing, if necessary washing and/or stabilizing; prehardening, neutralizing, color developing, stop-fix, washing, bleaching, fixing, washing, post-hardening, and then washing; color developing, washing, supplementary color developing, stopping, bleaching, fixing, washing and then stabilizing; halogenation bleach of the developed silver produced by color developing, and then additional color developing, thereby increasing the amount of the formed dye; and the like.

The color developer solution for use in the processing of the silver halide color photographic material of this invention is an alkaline solution containing a color developing agent, whose pH is preferably not less than 8, and more preferably from 9 to 12. The color developing agent is an aromatic primary amine developing agent, a compound of an aromatic ring having thereon a primary amino group, which is capable of developing the exposed silver halide. Further, the developer solution may, if necessary, contain a precursor which can form such the compound.

The above color developing agent is typified by p-phenylenediamine-type compounds, and useful examples of the agent include 4-amino-N,N-diethylaniline, 3-methyl-4-amino-N,N-diethylaniline, 4-amino-N-ethyl-N-β-hydroxyethylaniline, 3-methyl-4-amino-N-β-hydroxyethylaniline, 3-methyl-4-amino-N-ethyl-N-β-methoxyethylaniline, 3-methyl-4-amino-N-ethyl-N-β-methanesulfonamidoethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline, and sulfates, hydrochlorides, sulfites, p-toluenesulfonates, etc. of these compounds.

Further, those described in, e.g., Japanese Patent O.P.I. Publication Nos. 64932/1973, 131526/1975 and 95849/1976, and Bent, et al, the Journal of the American Chemical Society, vol. 73, p. 3100–3125 (1951) may be examples representative of the agent.

The using quantity of any of these aromatic primary amino compounds depends on to what extent the activity of a developer solution should be settled. In order to raise the activity, it is desirable to increase the using quantity. The using quantity is in the range of from 0.0002 mole/liter to 0.7 mole/liter. Two or more of such compounds may be used in arbitrary combination according to the purpose for which the photographic material is used; for example, the 3-methyl-4-amino-N,N-diethylaniline, and 3-methyl-4-amino-N-ethyl-N-β-methanesulfonamidoethylaniline, the 3-methyl-4-amino-N-ethyl-N-β-methanesulfonamidoethylanilin and 3-methyl-4-amino-N-ethyl-N-β-hydroxyethylaniline, and the like.

The color developer solution used in this invention may further contain various components usually used in ordinary developer solutions; for example, an alkali agent such as sodium hydroxide, sodium carbonate, etc., an alkali metal sulfite, an alkali metal hydrogensulfite, an alkali metal thiocyanate, an alkali metal halide, benzyl alcohol, water softener, thickening agent, development accelerator, and the like.

Those additives other than the above ones to be added to the above color developer solution include bromides such as potassium bromide, ammonium bromide, etc., alkali iodides, compounds for rapid processing use such as nitrobenzimidazole, mercaptobenzimidazole, 5-methyl-benzotriazole, 1-phenyl-5-mercaptotetrazole, etc., antistain agents, antisludge agents, preservatives, interimage effect accelerators, chelating agents, and the like.

Those generally known as the bleaching agent used in a bleaching bath or bleach-fix bath are compounds of an organic acid such as aminopolycarboxylic acid, oxalic acid, citric acid, etc., to which are coordinated metallic ions of iron, cobalt, copper, etc. Typical examples of the above aminopolycarboxylic acid include the following compounds:

Ethylenediaminetetraacetic acid,
Diethylenetriaminepentaacetic acid,
Propylenediaminetetraacetic acid,
Nitrilotriacetic acid,
Iminodiacetic acid,
Ethyl-ether-diaminetetraacetic acid,
Ethylenediaminetetrapropionic acid,
Disodium ethylenediaminetetraacetate,
Pentasodium diethylenetriaminepentaacetate, and
Sodium nitrilotriacetate.

The bleaching bath may contain various additives along with any of the above bleaching agents. When using a bleach-fix bath in the bleaching process, a solution of a composition containing a silver halide fixing agent in addition to the foregoing bleaching agent is applied. The bleach-fixing bath may further contain halide compounds such as potassium bromide. And similarly to the foregoing bleaching bath, the bleach-fix bath may contain various other additives such as, e.g., a pH buffer, brightening agent, defoaming agent, surfactant, preservative, chelating agent, stabilizer, organic solvent, and the like.

As the silver halide fixing agent those compounds reacting with silver halides to form water-soluble silver salts as used in ordinary fixation may be used which include, e.g., sodium thiosulfate, ammonium thiosulfate, potassium thiocyanate, sodium thiocyanate, thiourea, thioether, and the like.

The color developing, bleach-fix (or bleaching, fixing), additional washing, stabilizing, and drying of the silver halide color photographic material of this invention are all desirable to take place at a temperature of not less than 30° C. from the rapid processing point of view.

The silver halide color photographic material of this invention may be subjected to any of those stabiliztion treatments substituting for washing as described in Japanese Patent O.P.I. Publication Nos. 14834/1983, 105145/1983, 134634/1983 and 18631/1983, and Japanese Patent Application Nos. 2709/1983 and 89288/1984.

The processing in combination with the stabilization treatment substituting for washing is advantageous particularly in respect of the mobility and antipollution characteristic of image-forming apparatus without pipe arrangement.

EXAMPLES

The present invention will be illustrated in detail by the following examples.

EXAMPLE 1

[Preparation of Emulsions]

The silver chlorobromide emulsions given in the following Table 1 were prepared in similar manner to the method of preparing silver halide emulsions described in Japanese Patent O.P.I. Publication No. 45437/1984, corresponding to U.S. Pat. No. 4,591,549. These emulsions were chemically sensitized in usual manner. And of these emulsions the emulsions P-1 and P-2 were spectrally sensitized in usual manner by using a red-sensitizing dye, and the emulsions O-1 through O-9 were spectrally sensitized by using a green-sensitizing dye.

TABLE 1

| EM name | Color sensitivity | Mean grain size (μm) | AgBr content (mole %) | Remarks |
|---|---|---|---|---|
| R-1 | Blue-sensitive | 0.5 | 90 | — |
| O-1 | Green-sensitive | 0.30 | 80 | Non-invention |
| O-2 | " | " | 90 | Non-invention |
| O-3 | " | " | 75 | Non-invention |
| O-4 | " | " | 70 | Non-invention |
| O-5 | " | " | 65 | Invention |

TABLE 1-continued

| EM name | Color sensitivity | Mean grain size (μm) | AgBr content (mole %) | Remarks |
|---|---|---|---|---|
| O-6 | " | " | 60 | Invention |
| O-7 | " | " | 50 | Invention |
| O-8 | " | " | 40 | Invention |
| O-9 | " | " | 30 | Invention |
| P-1 | Red-sensitive | " | 80 | — |
| P-2 | " | " | 50 | — |

[Preparation of color paper samples]

On a polyethylene-laminated paper support were coated in order from the support side the following layers, whereby a silver halide color photographic material sample No. 1 was prepared.

Layer 1 . . . Layer containing 1.2 g/m$^2$ of gelatin, 0.32 g/m$^2$ (silver equivalent, same shall apply hereinafter) of blue-sensitive silver chlorobromide emulsion R-1, and 0.80 g/m$^2$ of yellow coupler (Y-1) dissolved into 0.50 g/m$^2$ of dioctyl phthalate.

Layer 2 . . . Interlayer comprising 0.7 g/m$^2$ of gelatin, 10 mg/m$^2$ of antiirradiation dye (AI-1), and 5 mg/m$^2$ of (AI-2).

Layer 3 . . . Layer containing 1.25 g/m$^2$ of gelatin, 0.22 g/m$^2$ of green-sensitive silver chlorobromide emulsion O-1, and 0.62 g/m$^2$ of magenta coupler (M-1) dissolved into 0.30 g/m$^2$ of dioctyl phthalate.

Layer 4 . . . Interlayer comprising 1.2 g/m$^2$ of gelatin.

Layer 5 . . . Layer containing 1.4 g/m$^2$ of gelatin, 0.20 g/m$^2$ of red-sensitive silver chlorobromide emulsion P-1, and 0.45 g/m$^2$ of cyan coupler (C-1) dissolved into 0.20 g/m$^2$ of dioctyl phthalate.

Layer 6 . . . Layer containing 1.0 g/m$^2$ of gelatin, and 0.30 g/m$^2$ of Tinuvin 328 (product of Ciba Geigy, (AG), ultraviolet absorbing agent) dissolved into 0.20 g/m$^2$ of dioctyl phthalate.

Layer 7 . . . Layer containing 0.5 g/m$^2$ of gelatin.

Y-1

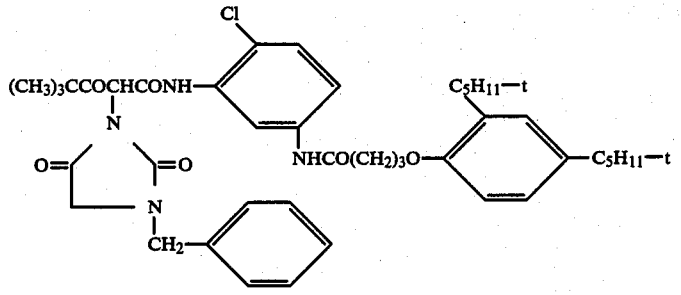

M-1

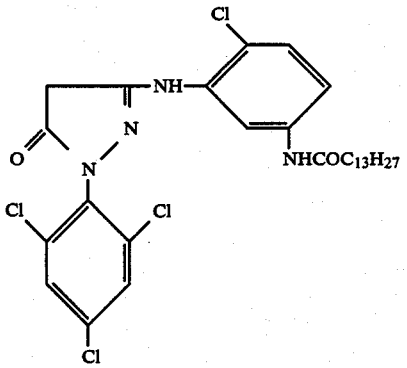

C-1

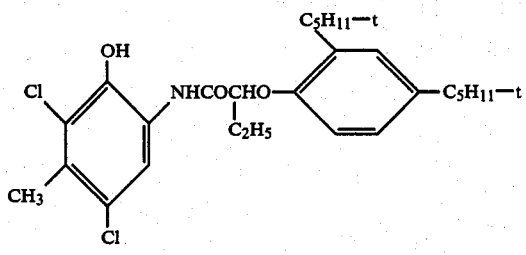

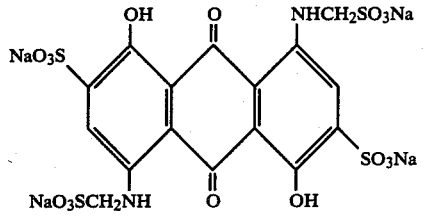

-continued

A1-1 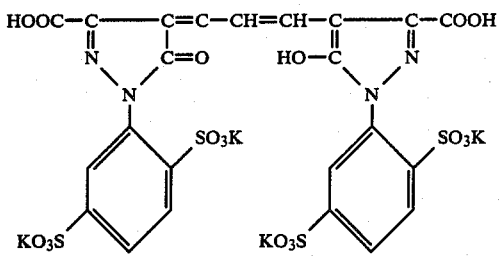 A1-2

In addition, a hardener sodium 2,4-dichloro-6-hydroxy-S-triazine was added to Layers 2, 4 and 7 so that its quantity is 0.017 g per gram of the gelatin of each of the layers.

Samples 2 through 10 were prepared as shown in Table 2, using the emulsions given in Table 1.

TABLE 2

| Sample No. | Silver bromide content(%) R | O | P | |
|---|---|---|---|---|
| 1 | 90 | 80 | 80 | Non-invention |
| | R-1 | O-1 | P-1 | |
| 2 | 90 | 90 | 80 | " |
| | R-1 | O-2 | P-1 | |
| 3 | 90 | 75 | 80 | " |
| | R-1 | O-3 | P-1 | |
| 4 | 90 | 70 | 80 | " |
| | R-1 | O-4 | P-1 | |
| 5 | 90 | 65 | 80 | Invention |
| | R-1 | O-5 | P-1 | |
| 6 | 90 | 60 | 80 | " |
| | R-1 | O-6 | P-1 | |
| 7 | 90 | 50 | 80 | " |
| | R-1 | O-7 | P-1 | |
| 8 | 90 | 40 | 80 | " |
| | R-1 | O-8 | P-1 | |
| 9 | 90 | 30 | 80 | " |
| | R-1 | O-9 | P-1 | |
| 10 | 90 | 50 | 50 | " |
| | R-1 | O-6 | P-2 | |

[Processing]

The above photographic material samples (Samples No. 1 to No. 10) each was exposed through an wedge by a laser printer of the prior art (shown in the drawing), and then processed in the following procedure:

| Processing Steps (38° C.) | |
|---|---|
| Color developing | 3 minutes |
| Bleach-fix | 1 minute |
| Washing | 1 minute |
| Drying | 2 minutes at 60–80° C. |

The compositions of the respective processing solutions are as follows:

[Color developer]

| | |
|---|---|
| Pure water | 800 ml |
| Benzyl alcohol | 15 ml |
| Hydroxylamine sulfate | 2.0 g |
| Potassium bromide | 1.5 g |
| Sodium chloride | 1.0 g |
| Potassium sulfite | 2.0 g |
| Triethanolamine | 2.0 g |
| N—ethyl-N—β-methanesulfonamidoethyl-3-methyl-4-aminoaniline sulfate | 4.5 g |
| 1-hydroxyethylidene-1,1-diphosphonic acid (aqueous 60% solution) | 1.5 ml |
| Potassium carbonate | 32.0 g |
| Whitex BB (aqueous 50% solution)(brighten- | 2 ml |

-continued

| | |
|---|---|
| ing agent, product of Sumitomo Chemical Industry Co., Ltd.) | |
| Add pure water to make 1 liter | |
| Use 20% potassium hydroxide or 10% dilute sulfuric acid to adjust the pH to 10.1. | |

[Bleach-fix bath]

| | |
|---|---|
| Pure water | 550 ml |
| Iron(III)-ammonium ethylenediamine tetraacetate | 65.0 g |
| Ammonium thiosulfate | 85.0 g |
| Sodium hydrogensulfite | 10.0 g |
| Sodium metabisulfite | 2.0 g |
| Iron-disodium ethylenediaminetetraacetate | 20.0 g |
| Sodium bromide | 10.0 g |
| Add pure water to make 1 liter | |
| Use aqueous ammonia or dilute sulfuric acid to adjust the pH to 7.0. | |

The obtained results are shown in Table 3.

TABLE 3

(Yellow turbidity evaluation: exposed to blue light)

| | M/Y(%) | C/Y(%) |
|---|---|---|
| Conventional paper, conventional exp. | 7.8 | 0.1 |
| Conventional paper, laser exp. | 11.6 | 0.2 |
| Sample (10), laser exp. | 7.7 | 0.1 |

Table 3 shows the results of the percentaged yellow/magenta (M/Y) and yellow/cyan (C/Y) proportions with respect to the three different prints obtained by the conventional printing process in which a conventional paper [Sakuracolor PC Paper Type SR, manufactured by Konishiroku Photo Ind. Co., Ltd. (hereinafter called SR paper)] was printed from a film negative by a transmission exposure to a blue light, the laser printing process in which the conventional paper (SR paper) was exposed to a blue laser beam light, and the laser printing process in which Sample (10) was exposed to the blue laser beam light.

From the above results it is understood that, according to the present invention, an image whose color turbidity is much smaller than that of the image obtained in the conventional color paper.

EXAMPLE 2

Similar experiments to Example 1 were conducted using Samples 1 through 10 different in the silver bromide content. The results are given in Table 4.

TABLE 4

| Sample No. | M/Y | C/Y | |
|---|---|---|---|
| 1 | 12.9 | 0.2 | Non-invention |
| 2 | 13.8 | 0.2 | " |
| 3 | 12.3 | 0.2 | " |

TABLE 4-continued

| Sample No. | M/Y | C/Y | |
|---|---|---|---|
| 4 | 11.6 | 0.2 | " |
| 5 | 10.5 | 0.2 | Invention |
| 6 | 9.8 | 0.2 | " |
| 7 | 7.7 | 0.2 | " |
| 8 | 6.7 | 0.2 | " |
| 9 | 5.8 | 0.2 | " |
| 10 | 7.7 | 0.1 | " |

From the above table it is understood that satisfactory results can be obtained in the case where the silver bromide content is not more than 65% (preferably not more than 55%).

What is claimed is:

1. A method of producing a photographic image comprising, (a) a step of imagewise exposing a silver halide color photosensitive material to blue, green and red lights by means of laser scanning, and, thereafter, (b) a step of developing said exposed color photosensitive material, characterized in that said silver halide color photosensitive material comprises a blue-sensitive emulsion layer, a green-sensitive emulsion layer and a red-sensitive emulsion layer, said red-sensitive layer and/or said green sensitive layer containing a silver iodochloride or a silver chloro-iodo-bromide containing silver bromide in an amount not more than 65 mol %.

2. The method of claim 1 wherein said amount is not more than 55 mol %.

3. The method of claim 1 wherein said amount is at least 5 mol %.

4. The method of claim 1, wherein said light beam is divided into picture elements and an exposing time period of said light beam on said photographic material is less than $10^{-2}$ second per picture element.

5. The method of claim 3, wherein the size of an apperture of said picture element is less than 1000 μm.

6. The method of claim 4, wherein the number of graduations of each of said light beams corresponding to the wavelengths of red, blue and green colors is more than four steps.

7. The method of claim 5, wherein the silver halide in said red sensitive silver halide emulsion layer contains silver bromide zero to 65 mol% thereof.

8. The method of claim 6, wherein the average size of silver halide grains in said blue sensitive silver halide emulsion layer is 0.2 to 1.0 μm.

9. The method of claim 7, wherein said green sensitive silver halide emulsion layer contains monodisperse silver halide.

10. The method of claim 1, wherein at least one of said rayers contains a silver chloro-iodo-brmide containing silver bromide in a quantity of 5 to 65 mol%.

* * * * *